US006227580B1

(12) United States Patent
Sundby

(10) Patent No.: US 6,227,580 B1
(45) Date of Patent: May 8, 2001

(54) MOUNTABLE MECHANISM FOR TYING KNOTS IN INFLATED BALLOONS

(76) Inventor: Ray L. Sundby, 195 W. Elm St., Lousiville, CO (US) 80027

( * ) Notice: Subject to any disclaimer, the term of this patent is extended or adjusted under 35 U.S.C. 154(b) by 0 days.

(21) Appl. No.: 09/507,860

(22) Filed: Feb. 22, 2000

(51) Int. Cl.[7] ..... D03J 3/00
(52) U.S. Cl. ..... 289/17; 289/2
(58) Field of Search ..... 289/2, 17, 18.1; 446/220, 222

(56) References Cited

U.S. PATENT DOCUMENTS

| | | | | |
|---|---|---|---|---|
| 3,575,449 | | 4/1971 | Browning | 289/1.5 |
| 3,625,556 | * | 12/1971 | Stromberg | 289/17 |
| 3,712,651 | | 1/1973 | Shockley | 289/17 |
| 3,752,516 | | 8/1973 | Mumma | 289/17 |
| 5,039,142 | | 8/1991 | Muma . | |
| 5,314,217 | * | 5/1994 | Place | 289/17 |
| 5,611,578 | | 3/1997 | Angelico et al. | 289/17 |
| 5,820,169 | * | 10/1998 | Butler et al. | 289/2 |
| 5,882,051 | | 3/1999 | Dreger et al. | 289/17 |

* cited by examiner

*Primary Examiner*—Michael A. Neas

(57) ABSTRACT

A knot-tying assembly is provided for tying overhand knots in an elastic material, such as the stem of an inflated balloon. The knot-tying assembly includes a mounting base for attaching the knot-tying assembly to a structure, such as an inflation gas regulator, and support arm rigidly connected to and extending outward from the base. The support arm includes an extension at the end distal from the base with a recessed mounting surface. A pair of posts is mounted on this recessed mounting surface with the posts positioned substantially parallel to each other and spaced apart a distance that defines a ring-retaining slot. During operation, the stem of an inflated balloon is positioned within the slot, and the ring is retained in position, at least in part, by the two posts. The knot-tying assembly further includes a slidable, hollow form which is positioned in contact with the outer surface of the support arm. During operation, the hollow form provides a surface for wrapping the stem of the balloon to define a loop for forming a knot. The hollow form is selectively positionable in a retracted position, at the beginning of the knot-tying process, and then in an extended position, at an intermediary step in the knot-tying process. Operation of the knot-tying assembly is completed by returning the hollow form to the retracted position to uncover the end of the ring-retaining slot which allows the stem of the balloon to be removed from the support arm extension.

15 Claims, 1 Drawing Sheet

MOUNTABLE MECHANISM FOR TYING KNOTS IN INFLATED BALLOONS

BACKGROUND OF THE INVENTION

1. Field of the Invention

The present invention relates generally to devices and tools for tying knots, and more particularly, to a mechanism or assembly, that is adapted for rigid mounting to allow a user to use two hands to operate the mechanism, for tying an overhand knot in the stem of an inflated balloon.

2. Description of the Related Art

Toy or party balloons made of elastic material are used in large numbers around the world requiring a person to tie a knot in each balloon to seal the air or other gas, such as helium, inside the balloon. An overhand knot is the typical way to seal the gas inside once the balloon is inflated. Although tying an overhand knot in a piece of string or rope is a relatively easy task, tying an overhand knot in the stem of an inflated balloon is a more difficult task. The stem, i.e., the portion of the balloon that is relatively uninflated near the opening or ring, is usually too short to form a loop with a person's fingers or otherwise that will remain open or relatively loose on its own. The balloon ring on the open end of the stem is relatively large and thus difficult to pass through the small loop typically around a person's fingers. In addition to being a relatively difficult task, tying a large number of balloons completely by hand can lead to pain or repetitive motion injuries for the individual(s) assigned this task.

A number of devices have been developed to assist individuals with this knot tying task. For example, U.S. Pat. No. 5,039,142 to Muma generally discloses a simple plate-like device with slots and a recessed surface that a user holds in one hand and manipulates a balloon with the other hand. Because the hand-held device has no moving parts, the user has to first wrap the balloon stem around and into the device to form a loop. Further manipulation of the loop of balloon stem and/or the balloon ring is then required to form the knot and extricate the knotted balloon from the device with one hand while supporting the device with the other hand, which can be awkward for the user and often does not resolve the problem of repeated motion injuries and pain.

A number of other hand-held, knot-tying devices make use of tapered form surfaces (i.e., surfaces for forming the loop in the balloon stem during the knot tying process) and/or low friction coatings to assist the user in forming the knot or removing the balloon both of which typically increase the cost and complexity of manufacturing. See, for example, U.S. Pat. No. 5,882,051 to Dreger et al. and U.S. Pat. No. 5,611,578 to Angelico, Sr. et al.

In addition to devices specifically designed for balloons, a number of typically complex to manufacture and often complicated-to-use devices have been developed to assist individuals in typing knots, such as strong fishing knots. See, for example, U.S. Pat. No. 3,752,516 to Mumma. Similarly, U.S. Pat. No. 3,712,651 to Shockley discloses a relatively complicated to use and to manufacture device for tying a knot in fishing line. This device relies on the working combination of a multitude of moving parts including several internal springs and a clamp with movable jaws to hold the end of the material being tied. Additionally, the device includes a crank handle which must be turned to form the knot, a multiple arm linkage connecting the crank handle to the clamp, and a form sleeve which slides into a bore to push the loop off of the form. While this device may be useful for thin fishing line, it may have problems with the balloon film, i.e., elastic wall material, being pulled into the bore and jamming the device. The device is also complicated to operate, requiring a number of separate operations. First, the loop must be formed by wrapping the form. Second, the balloon ring must be secured in the clamp device. Third, the hand crank must be turned until the knot is formed and the loop is pushed off of the form. Fourth, the balloon must be grabbed as it is released from the clamp.

While these devices attempt to address some of the existing problems with tying a large number of knots in balloons, they fail to address and resolve many of the problems, including the pains and injuries caused by repetitive motion. Consequently, there remains a need for an apparatus for resolving the ongoing problems associated with tying knots in balloons and other elastic material. Particularly, a balloon, knot-tying device is needed that can gain widespread acceptance in the market. Further, the device preferably will be easy to use, quick to operate, and economical to manufacture in quantity.

SUMMARY OF THE INVENTION

It is an object of the present invention to provide an apparatus for effectively and efficiently tying a knot in a stem of an inflated balloon or other elastic object.

It is a related object of the present invention to provide an apparatus for tying a knot in the stem of an inflated balloon that is simple and quick to operate by a user to better control the occurrence of pain and injury to the user even after numerous operations of the apparatus.

It is another related object of the present invention to provide an inexpensive and reliable apparatus for tying knots in the stem of inflated balloons that is inexpensive to manufacture and maintain.

Additional objects, advantages, and novel features of the invention will be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described therein, a knot-tying assembly is provided that generally comprises a mounting base, a support arm extending from the mounting base, and a hollow form (i.e., structure for enabling a user to form a properly-sized loop) positioned and configured to slide over the outer surface of the support arm to allow a user to quickly and efficiently tie a knot in the stem of a balloon.

According to one aspect of the invention, the knot-tying assembly is configured to be rigidly mounted to allow the user of the assembly to have two hands free for manipulating an inflated balloon and the assembly. In one embodiment, the knot-tying assembly includes an integral mounting base that is adopted for rigid mounting to a support structure such as a wall and the like. In this regard, the mounting base includes holes for fasteners, such as screws or bolts, although the mounting base could be otherwise fastened to a support structure (e.g., by welding and the like). In another embodiment, the mounting base is configured for mounting to a helium or other gas regulator that is used to fill balloons. In this embodiment, the mounting base includes holes for fasteners that attach the mounting base to an intermediate mounting block, which is configured for connection to the regulator. Alternatively, the mounting base may include male or female threaded connectors for directly mounting onto the regulator.

According to another aspect of the invention, the knot-tying assembly is adapted to be easy to use in tying an effective sealing knot in an inflated balloon and to be readily and inexpensively manufactured. In this regard, the mounting base, the support arm, the form, and other components of the knot-tying assembly are fabricated from inexpensive and readily available materials selected for characteristics of rigidity, strength, and wear-resistance, such as, for example, any of a number of metals and plastics. In one embodiment, all of the components are fabricated from metals, such as carbon steel, that can be readily machined and welded.

For ease of manufacture and use, the knot-tying assembly includes a support arm extending substantially perpendicularly outward from the mounting base. The support arm is generally cylindrical in cross-sectional shape to provide support and mating surfaces for the hollow, cylindrical-shaped form that is mounted on the support arm to be able to move parallel to a longitudinal axis of the support arm. The support arm includes a guide pin that extends outward on diametrically opposing sides of the support arm to contact inner surfaces of a first and second guide slot cut into the walls of the form. In this manner, the form can be positioned in a fully retracted position, a fully extended position, and intermediate positions which are established or defined by the length of the guide slots.

To hold the balloon during knot-tying operations, the support arm includes components for holding the stem and ring of the balloon. Any number of ring retaining devices can be employed, and in one embodiment, an outer and an inner post are attached to a recessed surface on the outwardly extending portion, i.e., an extension, of the support arm. The posts are positioned parallel to each other and spaced apart to provide a space, i.e., a ring-retaining slot, which is large enough to receive the stem of the balloon but smaller than the ring of the balloon. The posts extend from the recessed surface of the extension a distance that is adequate to retain the stem of the balloon but small enough to not contact the inner surface of the walls of the hollow form as it is slid over the posts during knot-tying operations. As will become apparent, these components lend themselves to inexpensive manufacture yet function effectively and efficiently in combination to allow a user to readily tie an overhand knot in an inflated balloon.

According to another aspect of the invention, the knot-tying assembly is configured for simple and quick operation to provide a knot that seals an inflated balloon. As will become clear from the following detailed description, knot-tying with the invention in general involves wrapping the stem of an inflated balloon around the form in the retracted position. During this wrapping step, a loop in the stem is formed and the ring is secured against the outer and inner posts with the stem in the ring-retaining slot. The balloon is then pulled outward away from the mounting base which moves the form toward the extended position. As the form moves, it first blocks the open end of the ring-retaining slot to contain the ring and second contacts the ring to shape or compress it to fit through the formed loop. The loop is moved beyond the ring until the form reaches its fully extended position which is defined by the guide pin and the guide slots. The balloon is pulled further away from the mounting base until the loop portion of the stem is pulled off the form and the knot is formed by the stem as it retracts or springs closed. Finally, the operator or user merely pulls the balloon slightly toward the mounting base and away from the support arm which functions to move the form to its retracted position which opens the ring retaining slot.

Other features and advantages of the invention will become clear from the following detailed description and drawings of particular embodiments and operation of the knot-tying assembly of the present invention.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings.

DETAILED DESCRIPTION OF THE INVENTION

Figure 1:
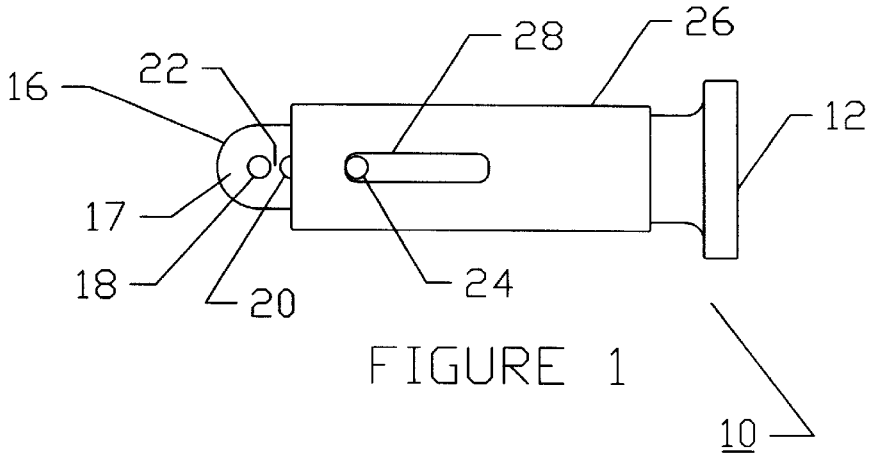
FIG. 1 is a front view of an embodiment of a knot-tying assembly according to the present invention.
Figure 2:
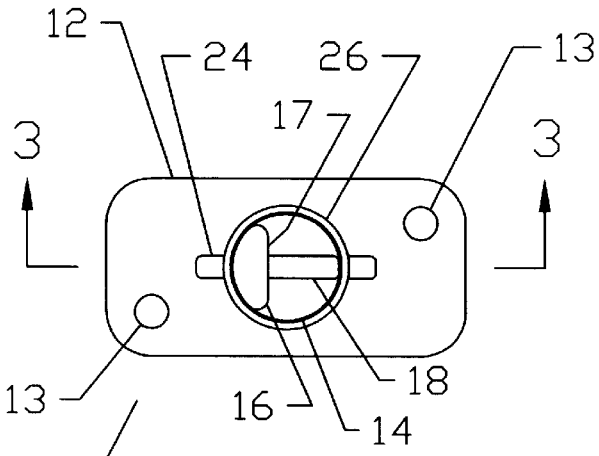
FIG. 2 is an end view of the knot-tying assembly illustrated in FIG. 1 illustrating one preferred shape for the movable, hollow form and illustrating the outer post for forming the ring-retaining slot.
Figure 3:
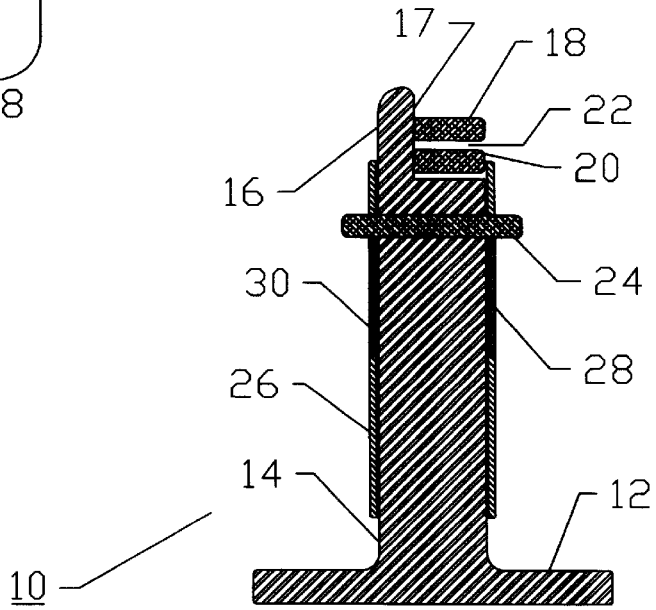
FIG. 3 is a cross-sectional view of the knot-tying assembly taken along line 3—3 of FIG. 2.

With the above brief summary of the invention understood, it may now be helpful in understanding the invention to provide a detailed description, with reference to FIGS. 1—3, of the inventive features of the invention. These features enable the invention to effectively and efficiently be employed by a user to tie overhand knots in the elastic material of the stem of an inflated balloon with little or no concern for repetitive motion injury. Although this description is directed specifically to elastic, e.g., rubber, balloons, the unique features of the invention make it readily adaptable for use in tying knots in other elastic objects fabricated from a variety of elastic and stretchable materials.

Referring to FIGS. 1—3, a knot-tying assembly 10 according to a preferred embodiment of the invention is illustrated. The knot-tying assembly 10 generally comprises a mounting base 12, a support arm 14 rigidly connected to the mounting base 12, and a form 26 that is movable (e.g., slidable) along the outer surface of the support arm 14. As will become clear from the following discussion, these elements are operated in combination to form a loop and then tie a knot in the stem of an inflated balloon (not shown) without requiring that the loop be formed with the operator's fingers, thereby limiting pain and discomfort caused by repeatedly rubbing an operator's fingers with the elastic material (e.g., rubber) of the balloon.

To further control possible operator pain, the mounting base 12 is included to rigidly mount the knot-tying assembly 10 to a structure. In this manner, the operator of the assembly 10 is able to use both hands to operate the assembly and manipulate the balloon, eliminating stress to the operator's forearm, wrist, and hand that occurs in devices that must be supported by the operator. It will be clear to those skilled in the mechanical arts that the mounting base may be any of a number of shapes, thicknesses, materials and the mounting base 12 may be configured to be attached to a number of structures such as a regulator used to control the filling of the balloons from a tank of gas (such as helium), a wall, or other suitable structure. As illustrated in FIGS. 1—3, the mounting base 12 is substantially rectangular with mounting holes 13 to facilitate attaching the mounting base 12 with fasteners, such as screws, bolts, and the like, to another structure such as a wall or an intermediary device (not shown). In a preferred embodiment, the intermediary structure is a block with a female or male adaptor to allow the knot-tying assembly 10 to be threaded or clamped onto a regulator (e.g., a helium regulator) directly or with the use of a clamp bolt and wing nut (not shown) to increase the convenience of using the knot-tying assembly 10. In another embodiment (not shown), the mounting base 12 includes an integral female or male adaptor for threaded engagement with a gas regulator.

The support arm 14 is rigidly connected to the mounting base 12. This connection can be achieved by a number of methods depending on the materials used to fabricate the base 12 and the support arm 14. For example, if plastic is used, both components may be integrally molded or formed separately and then attached with adhesives. In one embodiment, the support arm 14 and the mounting base 12 are fabricated from carbon steel, although other metals are acceptable, and the rigid connection is completed by welding.

The support arm 14 functions to support and guide the form 26 and to provide a method for grasping and retaining the ring at the open end of the balloon stem. In this regard, the cross-sectional shape and size of the support arm 14 can be varied significantly. It is preferable that the cross-sectional shape is selected to mate with the inner surface of the form 26, and for illustration, the cross-sectional shape may be triangular, square, or other polygonal shape or oval or other oblong shape. As illustrated, the support arm 14 has a circular cross-section which lends itself to ready manufacture from a standard steel rod and for mating with a hollow tube embodiment of form 26, as is shown in the figures (but, of course, other form cross-sectional shapes may be used with the invention). Additionally, the length and diameter of the support arm 14 may be selected from wide ranges to provide the desired functions. In a preferred embodiment, the length of the support arm 14 is selected to be in the range of 2 to 6 inches for ease and cost of manufacture, but a longer support arm 14 would also be within the scope of the invention.

The diameter of the support arm 14 may also be varied, but it is typically preferable that the diameter is selected to form a loop (as will be discussed more in the operation of the knot-tying assembly 10) that is large enough for the ring of the balloon to pass while not requiring that the balloon stem be stretched beyond its strength or require the operator to apply a large stretching force. In this regard, the inventor has found a support arm 14 diameter in the range of 0.5 to 2.0 inches to be effective for standard size balloons, while a larger diameter may be desirable for larger or nonstandard balloons.

The support arm 14 also provides the important function of retaining the ring of the balloon during knot-tying operations. As may be appreciated, a number of ring holding devices and means can be employed to practice the invention, such as a stem-sized, slot cut or molded into the end of the support arm 14 or even an extendable and retractable pin configured to pierce the elastic material of the stem near the ring. As illustrate in FIGS. 1—3, one embodiment of a ring holding device or means is provided by the combination of an extension 16 from the main portion of the support arm 14 having a recessed mounting surface 17 and an outer post 18 and an inner post 20 mounted to the extension 16 and extending outward from the recessed mounting surface 17. The mounting can be by any suitable method, such as integral forming/molding, threaded or press-fit connections, or welding.

The outer and inner posts 18, 20 are spaced apart a distance selected to define a ring-retaining slot 22 and are typically, substantially parallel to each other. This width of the slot 22 (i.e., the selected distance) is preferably large enough to allow a range of balloon stem sizes to be positioned within the slot 22 while concurrently being small enough such that the ring of this same range of balloon sizes cannot pass through the slot 22. The size of the ring can be thought of as the diameter of the loop of flexible material used to form the ring; the slot 22 preferably will not be large enough to allow a compressed ring to pass through, i.e., less than about twice the diameter of the loop of the ring. Of course, this width or distance will vary with the thickness of the material used to fabricate the balloon walls, but in one preferred embodiment is selected from the range of approximately 2 times the balloon wall thickness to approximately 30 times the balloon wall thickness but always less than the size of the ring (which is typically about 2 times the diameter of loop or material forming the ring as the ring collapses during knot-tying operations). The depth of the slot 22, as measure from the outer end of the posts 18, 20 to the recessed mounting surface 17, is preferably selected to readily accept the width of the balloon stem while not degrading the strength of the extension 16. Typically, the depth of the slot 22 or the length of the posts 18, 20 is about fifty to seventy-five percent of the diameter of the support arm 14. Preferably, the support arm 14, recessed surface 17, posts 18, 20, and other surfaces of the knot-tying assembly 10 are fabricated to have rounded corners and to remove burrs and sharp edges to minimize the tearing or puncturing of the elastic material of the stem or body of the balloon. In the above manner, the outer and inner posts 18, 20 effectively function as a ring-retaining device for the knot-tying assembly 10.

According to another significant feature, the knot-tying assembly 10 includes the form 26 which can be selectively positioned or moved in relation to the support arm 14 (and specifically the ring-retaining slot 22) to provide a contact surface for forming a loop in the stem of the balloon and for moving the stem during knot-tying operations, which will be discussed in more detail below. As explained for the support arm 14, the form may take a variety of cross-sectional shapes and have a variety of lengths, as long as these configurations provide effective mating surfaces and functionality with the shape and size of the support arm 14. Noncircular shapes may be useful for preventing rotation of the form 26 about a longitudinal axis of the support arm 14. In the illustrated embodiment, the form 26 comprises a length of a hollow, cylindrical tube with an inner diameter slightly larger than the outer diameter of the support arm 14. This clearance allows the form 26 to freely, or at least with minimal resistance and friction, slide along the outer surfaces of the support arm 14 during knot-tying operations.

As will become clear during the discussion of knot-tying operation of the knot-tying assembly 10, it is preferable that the form 26 be selectively positional in a retracted position which leaves the ring-retaining slot 22 open for insertion of a balloon stem and in an extended position that blocks or covers the open end of the ring-retaining slot 22 to retain the stem and ring during initial steps of knot tying. Additionally, the movement of the form 26 into the extended position acts to shape or compress the ring to facilitate its passing through the loop formed in the balloon stem. To control the movement of the form 26, the form 26 includes a first guide slot 28 and a second guide slot 30 on diametrically-opposed sides of the form 26 that run longitudinally parallel to a longitudinal axis of the support arm 14. These guide slots 28, 30 function in combination to limit the range of travel of the form 26, and the length of the guide slots 28, 30 is preferably selected to fully expose the ring-retaining slot 22 in the extended position and fully cover the ring-retaining slot 22 in the fully extended position.

The travel of the form 26 is controlled by the inclusion of a guide pin 24 which is fabricated from a small diameter rod, as illustrated in FIGS. 1 and 2, which contacts the guide slots 28, 30 at each end to define the retracted and extended positions of the form 26. In one method of fabrication, the guide pin 24 comprises a steel pin that is press fit into a holed drilled through the support arm 14. The guide pin 24 has a diameter that is selected to mate with the guide slots 28, 30 with minimal friction and a length selected to be larger than the diameter of the support arm 14 to extend outward and through the guide slots 28, 30 to provide a wrap surface for the stem of the balloon during the loop formation steps of knot tying.

Significantly, the guide pin 24 in combination with the first and second guide slots 28, 30 provide a number of benefits and functions including, but not limited to: (1) defining the retracted position of the movable form 26; (2) providing a locating surface and method for wrapping the loop formed in the stem of the balloon a preferred distance from the end of the movable form 26 and from the ring-retaining slot 22; (3) preventing the form 26 from rotating about the central axis of the support arm 14 while the loop is being formed; (4) with the support arm 14, constraining the form 26 to linear motion along the outer surface of the support arm 14; and (5) defining the extended position of the form 26.

With this understanding of the features of the invention understood, a preferred mode of operating the knot-tying assembly 10 will be provided to more fully explain the uniqueness and effectiveness of the combination and configuration of the features of the knot-tying assembly 10. Generally, knot-tying operations begin with mounting the knot-tying assembly 10 in a location proximal to where balloons are being filled with a gas, such as helium. Although the balloon may be held in a number of ways and the operator may be positioned relative to the knot-tying assembly 10 in a number of ways, the following description assumes that the operator is facing the knot-tying assembly 10 with the assembly 10 oriented as shown in FIG. 1.

Operations continue with an inflated balloon being held in the left hand by the operator. The operator pinches the stem of the balloon between their thumb and index finger with enough stem (i.e., a long enough portion) extending beyond the pinch point to form the loop and the desired knot. The operator then holds the ring of the balloon with the right hand by pinching it between their thumb and index finger. Next, the operator positions the stem to extend vertically, with their right hand and the ring on the now uppermost or top portion of the stem.

To wrap the loop part of the knot around the form 26 and secure the ring with the posts 18, 20 and ring-retaining slot 22, the stem is moved by the operator to the rear or distal portion of the form 26 and against the portion of the guide pin 24 extending from the rear portion of the form 26. The operator moves their left hand toward their body concurrently wrapping the stem under the form 26, up the front or proximal portion of the form 26, and then across the top or upper portion of the form 26 to the distal portion of the form 26. While the left hand is moving back across the upper portion of the form 26, the operator moves their right hand toward their body, thereby completing the formation of the loop at the upper portion of the form 26. The operator then continues to move their right hand to wrap the stem off the upper portion of the form 26 and into the ring-retaining slot 22. The operator next releases the ring with their right hand and does not need to use their right hand again during the knot-tying process.

The next step is completed by the operator by using a short quick pull to their left (i.e., away from the base 12) with their left hand. This pulling motion causes a number of beneficial events to occur in rapid sequence. The form 26 starts moving to the left, and the form 26 first blocks off the open end of the ring-retaining slot 22 such that the ring cannot come loose during further knot tying steps. As the form 26 continues to move left, it acts on the retained ring to compress and/or otherwise deform it into a shape that more readily fits and passes through the formed loop in the balloon stem. The formed loop continues to move left with the form 26 until the loop has passed by the retained ring, at which point the geometry of the knot has been substantially formed. At this point, the form 26 is in the fully extended position and cannot travel further to the left, with travel being stopped when the guide pin 24 contacts the left end of the guide slots 28, 30. Significantly, a low friction or tapered form 26 is not required and in some embodiments may not even be desirable because it is typically preferable that there be enough friction between the stem and the form 26 to move or pull the form 26 to the left until the form 26 qualifies or changes the ring shape and the loop is to the left of the retained ring.

In this regard, the knot-tying assembly 10 is adapted for tying knots in elastic materials with large enough elasticity and resiliency to return it readily to an unstretched state. Although tying knots in inflated rubber balloons is an important use for the invention, the knot-tying assembly 10 would be useful for tying nearly any elastic material and/or elastic device.

Returning to the specific mode of operation, as the operator's hand continues to move left, the loop in the balloon stem stretches and then pulls off the form 26. The form 26 outer surface may be relatively rough as long as it is smooth enough to avoid damaging the balloon materials causing leakage, popping, and the like. The elastic material of the balloon allows the knot-tying assembly 10 to function as the stem of the balloon functions as a pair of balanced springs. The first spring, between the operator's left hand and the form 26 and the ring-retaining slot 22 (and posts 18, 20), functions first to keep the loop in the stem tight against the form 26 and second to pull the knot tight when the loop snaps off of the form 26. The second spring, between the form 26 and the ring-retaining slot 22 (and posts 18, 20), functions first to keep the loop in the stem tight on the form 26 and second to pull the formed knot tight when the loop snaps or springs off of the form 26.

As a final step in the operation mode, the operator gently pulls the balloon to the right (i.e., toward the base 12) and slightly toward their body. This pulling movement returns (with the balloon) the form 26 to the retracted or initial position as guide pin 24 contacts the right end of the guide slots 28, 30. Finally, the balloon stem is pulled out of the now unblocked ring-retaining slot 22 resulting, typically, in an overhand-type knot that seals the gases within the balloon. Of course, during typical use by an operator, there may be little or no pausing amongst the above discussed steps, and each knot can be tied quickly and efficiently by the operator with only significantly reduced effort and stress on their forearm, wrist, and hand.

Since numerous modifications and combinations of the above method and embodiments will readily occur to those skilled in the art, it is not desired to limit the invention to the exact construction and processes shown and described above. For example, numerous materials can be used to fabricate the components of the knot-tying assembly that have physical characteristics to resist wear and resist damage during extended use, such as a variety of plastics and metals. Additionally, although not shown, a spring could be included and connected to the form 26 to automatically return the form 26 to the retracted position at the completion of knot tying. Further, the form 26 can include a shoulder toward the outer end to contact a portion of the support arm, such as the notch cut to form the recessed mounting surface 17, to limit travel and/or to define the retracted position of the form 26. Often, an operator will find it useful to use the device to hold a ribbon or string with the stem or between the form and support arm in the knot-tying process discussed above such that the ribbon is tied into the same balloon knot. Accordingly, resort may be made to all suitable modifications and equivalents that fall within the scope of the invention as defined by the claims which follow. The words "comprise," "comprises," "comprising," "include(s)," and "including" when used in this specification and in the following claims are intended to specify the presence of stated features or steps, but they do not preclude the presence or addition of one or more other features, steps, or groups thereof.

What is claimed is:

1. An apparatus for use by an operator for manually tying a knot in a stem of a balloon fabricated from elastic and resilient material adjacent the open end of the stem defined by a ring comprising a flexible loop having a diameter larger than the thickness of a wall of the stem, comprising:

an elongate support arm adapted for securement to a stationary structure;

a ring-retaining member connected to a first end of the support arm adapted for holding the ring of the balloon during knot-tying operations; and a hollow, elongate form member, for providing a mating surface for the balloon stem for forming an open loop in the stem during knot-tying operations, positioned over the support arm in abutting contact with an outer surface of the support arm;

wherein said form member slides with operator movement of the balloon over the outer surface of the support arm between a retracted position that exposes the ring-retaining member at the beginning and end of the knot-tying operations and an extended position that blocks access to the ring-retaining member.

2. The apparatus of claim 1, wherein said ring-retaining member comprises an outer post and an inner post mounted on an extension of the support arm traverse to a longitudinal axis of the support arm, the outer and the inner posts being spaced apart a predetermined distance to define a ring-retaining slot.

3. The apparatus of claim 2, wherein said predetermined distance is greater than about twice the thickness of the wall of the balloon stem and less than about twice the diameter of the loop of the balloon ring.

4. The apparatus of claim 1, wherein the support arm has a circular cross-sectional shape.

5. The apparatus of claim 1, further including a travel control means for controlling the direction and range of the movement of the form along the outer surface of the support arm.

6. The apparatus of claim 5, wherein the travel control means comprises a guide member that extends outward from the support arm and a first guide slot sized to receive the guide member comprising an elongate opening in the form with a longitudinal axis substantially parallel to a longitudinal axis of the support arm, the first guide slot having a first end that limits travel of the form in a first direction and defines the retracted position and a second end that limits travel of the form in a second direction and defines the extended position.

7. The apparatus of claim 6, wherein the guide member extends outward on two diametrically-opposing sides of the support arm and further comprises a second guide slot comprising an elongate opening in the form on the diametrically-opposing side from the first guide slot.

8. The apparatus of claim 1, further including a mounting base adjacent a second end of the support arm adapted for rigid attachment to a support structure, thereby allowing the operator to use two hands to manipulate the balloon during knot-tying operations.

9. The apparatus of claim 8, wherein the mounting base is configured for threaded connection with a gas regulator used to supply gas for inflating the balloon.

10. A knot-tying apparatus for use in tying an overhand knot in an elongate member fabricated from elastic and resilient material having a first segment with a material thickness and a second segment adjacent the first segment with a material thickness greater than the material thickness of the first segment, comprising:

an elongate support arm including an extension at a first end with a retention member for receiving a first portion of the first segment and retaining the second segment during knot-tying operations;

a mounting base adjacent and connected to a second end of the support arm adapted for rigid attachment to a support structure; and a hollow, elongate form member, with an outer surface for mating with a second portion of the first segment for use in forming an open loop in the first segment during knot-tying operations, positioned over the support arm in abutting contact with an outer surface of the support arm;

wherein said form member slides at least partially concurrently with movement of the first segment over the outer surface of the support arm between a retracted position that exposes the retention member at the beginning and end of the knot-tying operations and an extended position at which the form member blocks access to the retention member.

11. The apparatus of claim 10, wherein said retention member comprises an outer post and an inner post mounted on an extension of the support arm traverse to a longitudinal axis of the support arm, the outer and the inner posts being spaced apart a predetermined distance to define a retention slot.

12. The apparatus of claim 11, wherein said predetermined distance is greater than about twice the material thickness of the first segment and is less than about twice the material thickness of the second segment.

13. The apparatus of claim 10, further including a travel control means for controlling the direction and range of the movement of the form along the outer surface of the support arm.

14. The apparatus of claim 13, wherein the travel control means comprises a guide member that extends outward from the support arm and a first guide slot sized to receive the guide member comprising an elongate opening in the form with a longitudinal axis substantially parallel to a longitudinal axis of the support arm, the first guide slot having a first end that limits travel of the form in a first direction and defines the retracted position and a second end that limits travel of the form in a second direction and defines the extended position.

15. The apparatus of claim 14, wherein the guide member extends outward on two diametrically-opposing sides of the support arm and further comprises a second guide slot comprising an elongate opening in the form on the diametrically-opposing side from the first guide slot.

* * * * *